US009010048B2

(12) United States Patent
Nickell

(10) Patent No.: US 9,010,048 B2
(45) Date of Patent: Apr. 21, 2015

(54) SYSTEM AND METHOD FOR INSTALLING ORNAMENTAL MOLDING

(75) Inventor: Robert Lee Nickell, Austin, TX (US)

(73) Assignee: Robert Lee Nickell, Austin, TX (US)

( * ) Notice: Subject to any disclaimer, the term of this patent is extended or adjusted under 35 U.S.C. 154(b) by 0 days.

(21) Appl. No.: 13/614,600

(22) Filed: Sep. 13, 2012

(65) Prior Publication Data

US 2013/0205697 A1 Aug. 15, 2013

Related U.S. Application Data

(60) Provisional application No. 61/534,175, filed on Sep. 13, 2011, provisional application No. 61/534,186, filed on Sep. 13, 2011, provisional application No. 61/589,996, filed on Jan. 24, 2012.

(51) Int. Cl.
*E04B 2/00* (2006.01)
*E04F 19/04* (2006.01)

(52) U.S. Cl.
CPC ..... *E04F 19/04* (2013.01); *E04F 19/0436* (2013.01); *E04F 19/0495* (2013.01)

(58) Field of Classification Search
CPC ..... E04F 13/04; E04F 19/0436; E04F 19/02; E04F 13/06; E04F 2013/063
USPC ..... 52/287.1, 288.1, 459, 461, 465, 465.11, 52/718.04
See application file for complete search history.

(56) References Cited

U.S. PATENT DOCUMENTS

| | | | | | |
|---|---|---|---|---|---|
| 2,994,905 | A * | 8/1961 | Franker, Jr. | 52/273 |
| 3,302,350 | A * | 2/1967 | Brown et al. | 52/288.1 |
| 5,179,811 | A * | 1/1993 | Walker et al. | 52/288.1 |
| 5,359,817 | A * | 11/1994 | Fulton | 52/288.1 |
| 5,433,048 | A * | 7/1995 | Strasser | 52/288.1 |
| 5,463,835 | A * | 11/1995 | Wood | 52/288.1 |
| 6,755,000 | B2 * | 6/2004 | Wone Hahn | 52/287.1 |
| 7,210,272 | B2 * | 5/2007 | Friday | 52/288.1 |
| 7,370,453 | B2 * | 5/2008 | Puzio | 52/287.1 |
| D619,882 | S * | 7/2010 | Estok | D8/380 |
| 7,784,233 | B2 * | 8/2010 | Friedlich | 52/287.1 |
| D656,808 | S * | 4/2012 | Arvinte et al. | D8/90 |
| 2008/0016811 | A1 * | 1/2008 | Johnston et al. | 52/506.08 |
| 2009/0139168 | A1 * | 6/2009 | Grissom et al. | 52/288.1 |
| 2010/0313498 | A1 * | 12/2010 | Paidar et al. | 52/173.1 |

* cited by examiner

*Primary Examiner* — Chi Q Nguyen

(57) ABSTRACT

In some embodiments, a method of installing molding may include coupling a first molding block in a first corner formed by a first surface and a third surface and at a first distance from a second corner formed by the first surface and a second surface. The method may include coupling a lower side adjacent a first end of a first molding to a portion of a third surface of the first molding block such that a second end of the first molding is adjacent the second corner. The method may include coupling a second molding block in a third corner formed by a second surface and a third surface and at a second distance from the second corner. The method may include coupling a second molding to the second molding block such that the second ends of the first and second moldings connect forming a first joint forming a substantially right angle.

17 Claims, 6 Drawing Sheets

SYSTEM AND METHOD FOR INSTALLING ORNAMENTAL MOLDING

PRIORITY CLAIM

This application claims priority to U.S. Provisional Patent Application No. 61/534,175 entitled "PRE-CUT INNER AND OUTER CROWN MOLDING CORNERS WITH ALIGNMENT BLOCKS" filed on Sep. 13, 2011, U.S. Provisional Patent Application No. 61/534,186 entitled "CROWN MOLDING ALIGNMENT BLOCKS" filed on Sep. 13, 2011, and U.S. Provisional Patent Application No. 61/589,996 entitled "CROWN MOLDING INSTALLATION HANGER" filed on Jan. 24, 2012, all of which are incorporated by reference herein.

BACKGROUND OF THE INVENTION

1. Field of the Invention

The present disclosure generally the installation of molding. More particularly, the disclosure generally relates to systems and methods for facilitating the installation of crown molding.

2. Description of the Relevant Art

Ornamental molding is used to decorate residential and commercial structures throughout the world. Molding is typically used to decorate corners where walls meet. Crown molding is typically used to decorate a corner formed by the meeting of a wall and a ceiling. Modern processing techniques have allowed for the production of relatively inexpensive crown molding in a variety of patterns and styles. As such, crown molding has become extremely popular for decorating the interior of homes across the country. Unfortunately installing crown molding is quite difficult and requires a skilled carpenter to install properly.

United States Publication No. 20100313498 issued to Paidar et al. (hereinafter "Paidar") a method and system for installing decorative moldings including a mounting block made of a soft and light material adapted to be secured to a wall and extended about a border thereof. However, Paidar does not disclose, for example, mounting blocks including relatively short lengths which are configured to fit securely into corners which do not necessarily include right angles due in part to a shaved corner of the molding block. Although there exist many different types of precut fully assembled crown moldings none of the known devices accomplish what the herein described ornamental molding kits is capable of.

Therefore a system and/or method which facilitates home owners or other unskilled laborers in installing crown molding is highly beneficial.

SUMMARY

This disclosure describes systems and methods for facilitating the installation of ornamental molding (e.g., crown molding). In some embodiments, a method of installing molding may include coupling a first molding block in a first corner formed by a first surface and a third surface and at a first distance from a second corner formed by the first surface and a second surface. The method may include coupling a lower side adjacent a first end of a first molding to a portion of a third surface of the first molding block such that a second end of the first molding is adjacent the second corner. In some embodiments, the first molding includes a first length and the first molding block includes a first width is less than about 25% of the first length of the first molding. The method may include coupling a second molding block in a third corner formed by a second surface and a third surface and at a second distance from the second corner. The method may include coupling a lower side adjacent a first end of a second molding to a portion of a third surface of the second molding block such that a second end of the first crown molding is adjacent the second corner such that the second ends of the first and second moldings connect forming a first joint such that the first and second moldings are coupled at a substantially right angle.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
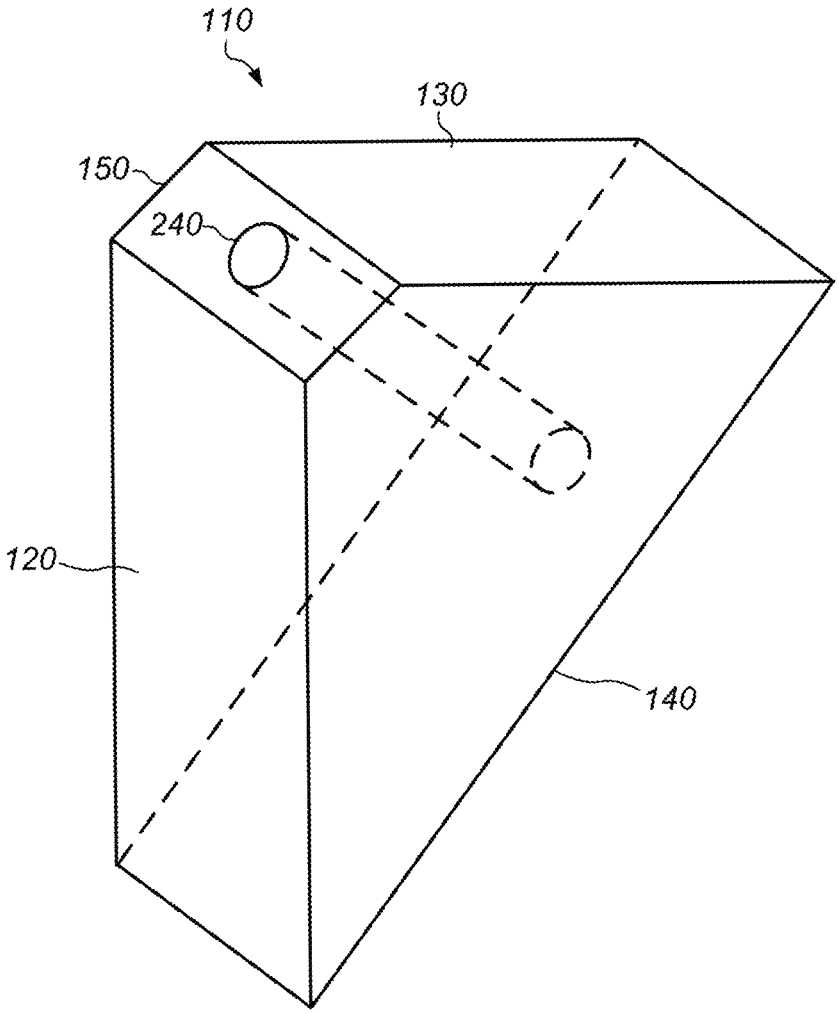
FIG. 1 depicts a perspective view of a diagram of an embodiment of a molding block.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third die electrically connected to the module substrate" does not preclude scenarios in which a "fourth die electrically connected to the module substrate" is connected prior to the third die, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task (e.g., a set of electrical conductors may be configured to electrically connect a module to another module, even when the two modules are not connected). In some contexts, "configured to" may be a broad recitation of structure generally meaning "having circuitry that" performs the task or tasks during operation. As such, the component can be configured to perform the task even when the component is not currently on. In general, the circuitry that forms the structure corresponding to "configured to" may include hardware circuits.

Figure 9:
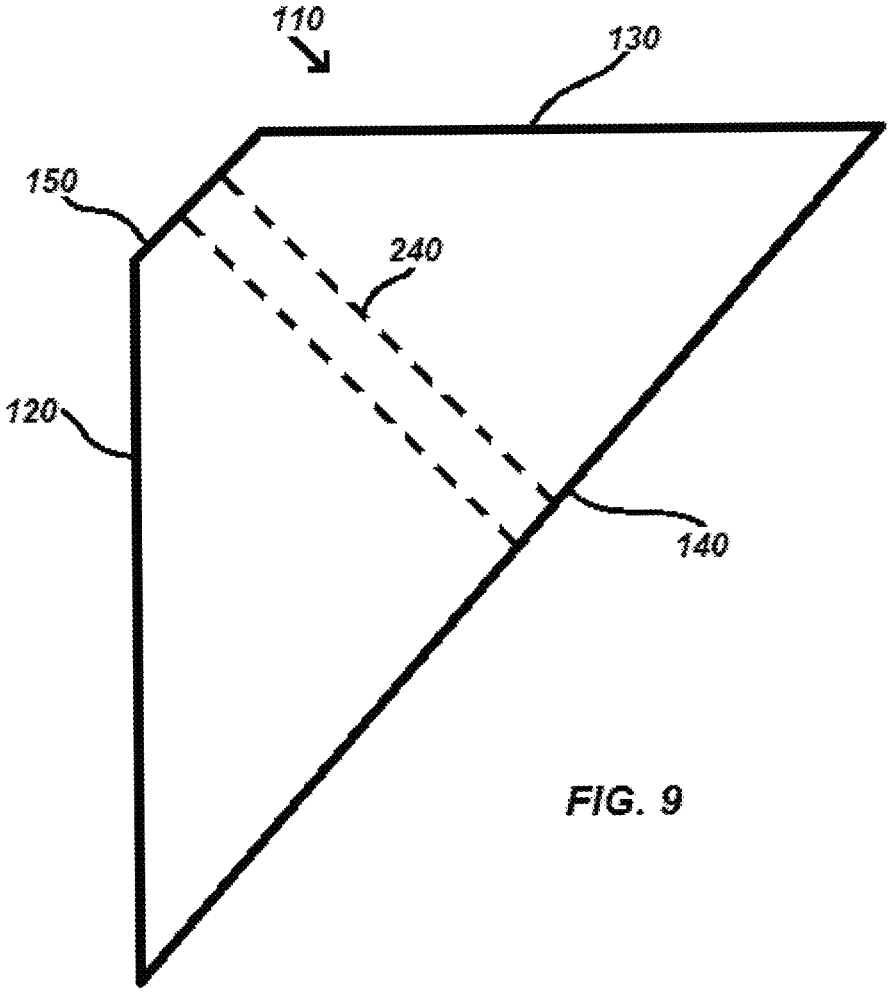

FIG. 9 depicts a side view of the molding block shown in FIG. 1.

Various components may be described as performing a task or tasks, for convenience in the description. Such descriptions should be interpreted as including the phrase "configured to." Reciting a component that is configured to perform one or more tasks is expressly intended not to invoke 35 U.S.C. §112, paragraph six, interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

In some embodiments, an ornamental molding kit 100 may include a first molding block 110*a* and a second molding block 110*b*. The first and second molding block may include a first 120, a second 130, a third 140, and a fourth side 150. FIG. 1 depicts a diagram of a perspective view of an embodiment of molding block 110.

Figure 2:
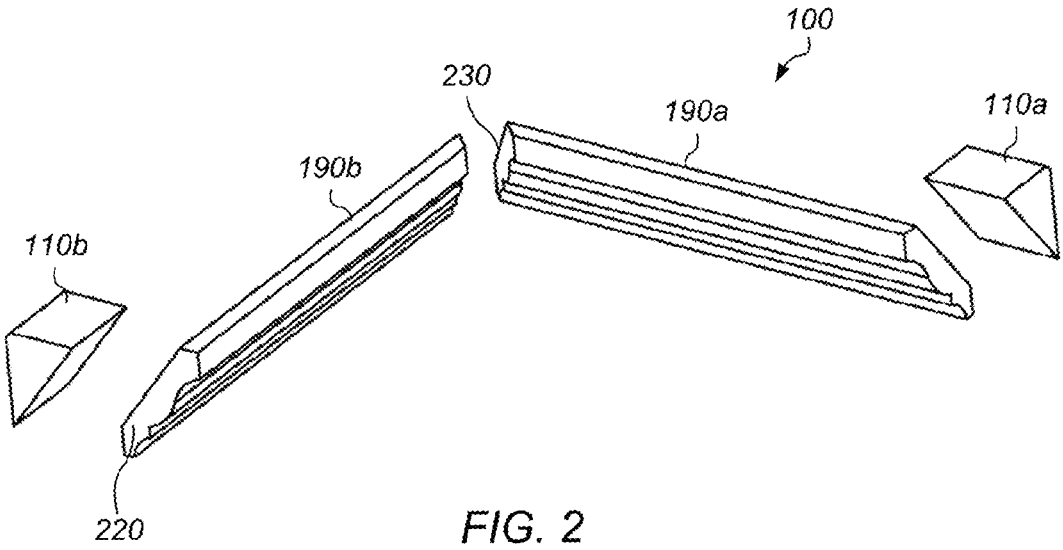
FIG. 2 depicts a perspective view of a diagram of an embodiment of an unassembled ornamental molding kit for inside corners.
Figure 4:
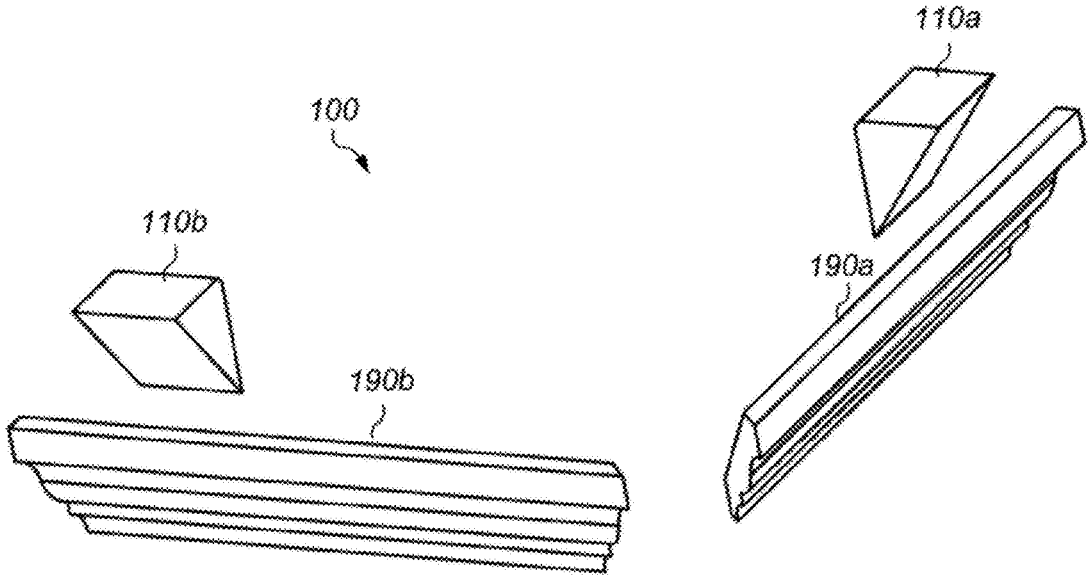
FIG. 4 depicts a perspective view of a diagram of an embodiment of an ornamental molding kit for outside corners.

FIG. 2 depicts a perspective view of a diagram of an embodiment of an unassembled ornamental molding kit 100 for inside corners. FIG. 4 depicts a perspective view of a diagram of an embodiment of an ornamental molding kit 100 for outside corners. In some embodiments, the first side of the first molding block is coupled, during use, to a first surface 160, and wherein the first side of the second molding block is coupled, during use, to a second surface 170 substantially perpendicular to the first surface.

FIG. 9 depicts a side view of the molding block shown in FIG. 1. As illustrated in FIG. 9, in some embodiments, the second side 130 may be substantially perpendicular to the first side 120. The second side may be coupled, during use to a third surface 180 perpendicular to the first surface and the second surface.

Figure 3:
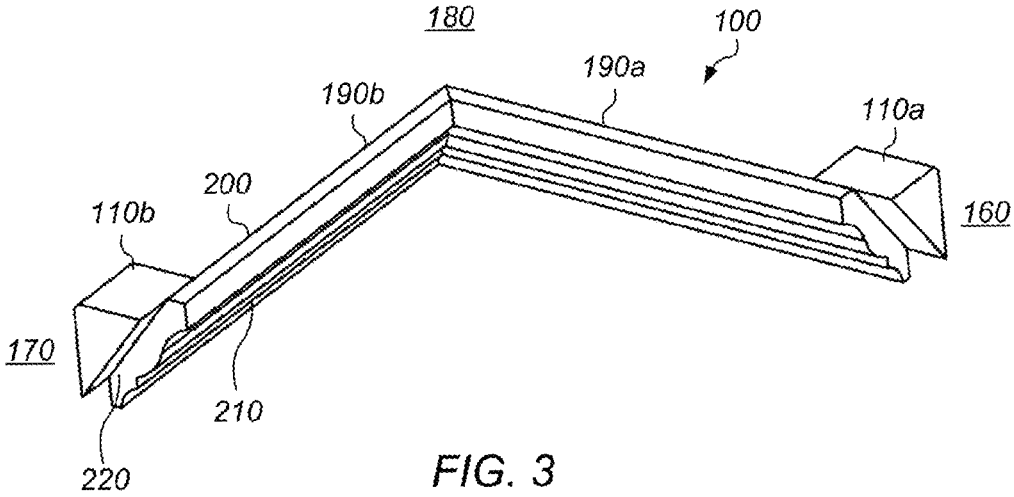
FIG. 3 depicts a perspective view of a diagram of an embodiment of an assembled ornamental molding kit for inside corners.
Figure 5:
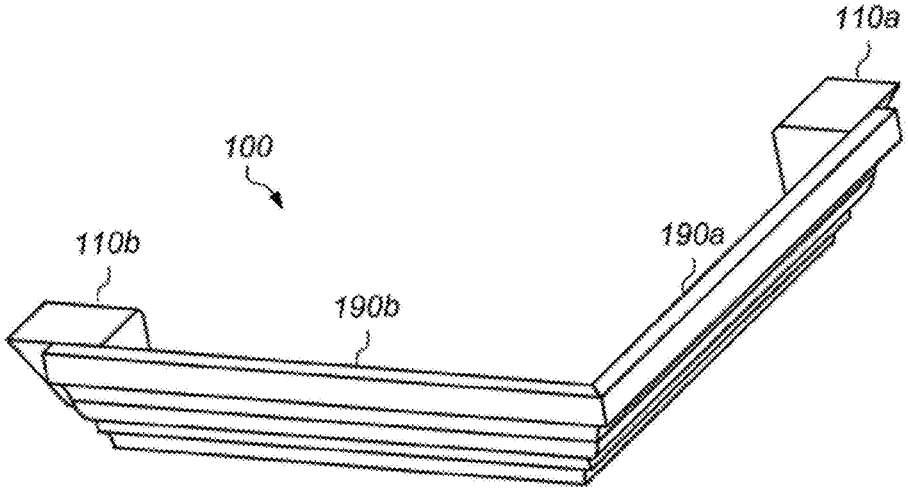
FIG. 5 depicts a perspective view of a diagram of an embodiment of an ornamental molding kit for outside corners.
Figure 6:
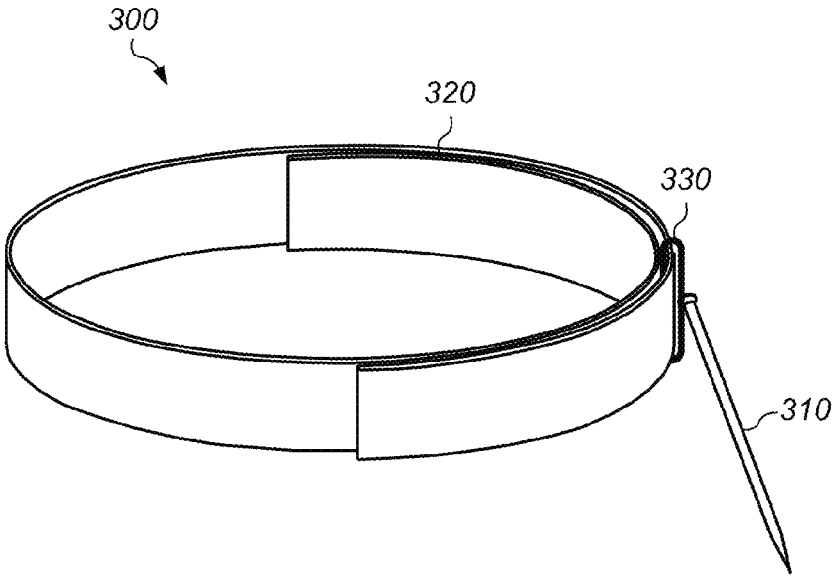
FIG. 6 depicts a perspective view of a diagram of an embodiment of an ornamental molding hanging device.
Figure 7:
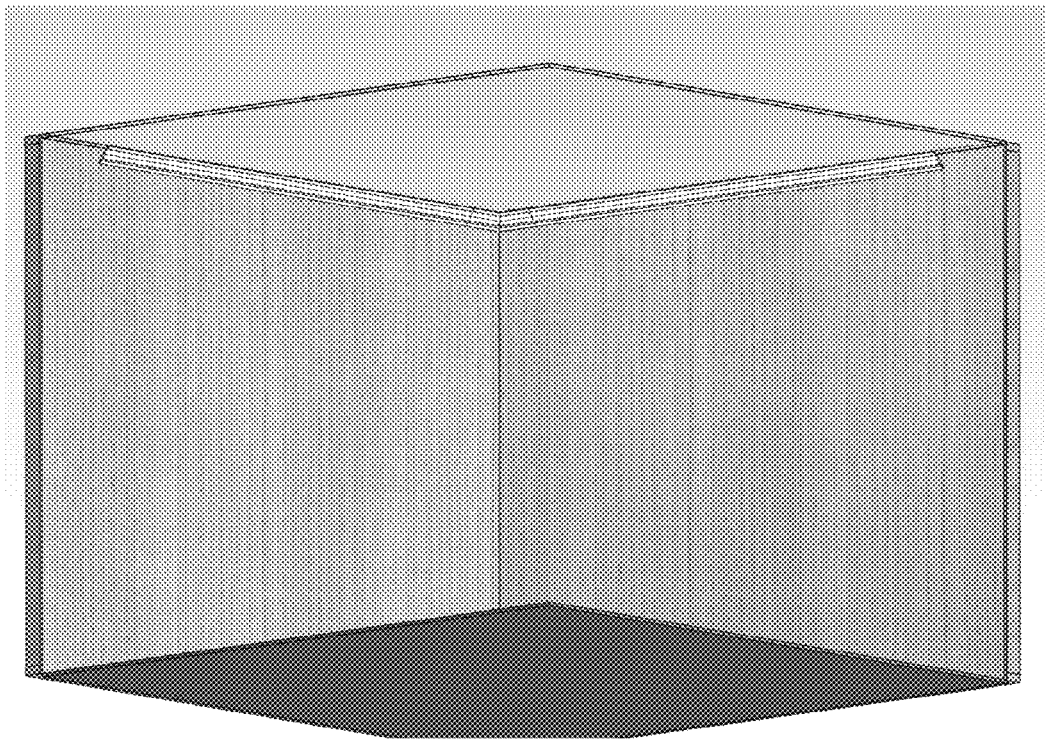
FIG. 7 depicts a perspective view from below of a diagram of an embodiment of an assembled ornamental molding kit for inside corners installed in a room.
Figure 8:
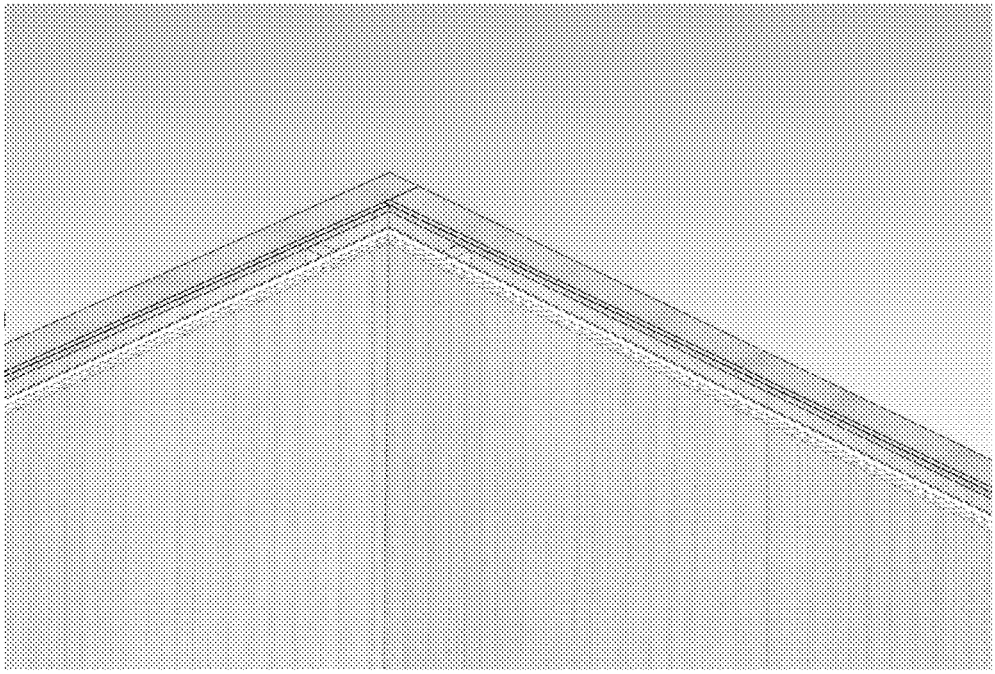
FIG. 8 depicts a perspective view from above of a diagram of an embodiment of an assembled ornamental molding kit for inside corners installed in a room.

In some embodiments, a third side 140 may couple the first side 120 and the second side 130. The third side may be substantially opposite the first side and the second side. In some embodiments, the angle of the third side relative to an opposing corner the molding block is coupled to, may function to set an angle for molding coupled to the third side of the molding block. The angle may vary depending upon the design of the molding and as such a molding block may be produced to accommodate the molding. Molding may be coupled to molding blocks using a variety of fastening mechanisms. Fastening mechanisms may include screws, nails, adhesives, etc. FIG. 3 depicts a perspective view of a diagram of an embodiment of an assembled ornamental molding kit 100 for inside corners. FIG. 5 depicts a perspective view of a diagram of an embodiment of an ornamental molding kit 100 for outside corners.

In some embodiments, a fourth side 150 may couple the first side 120 and the second side 130. The fourth side may be opposite and substantially parallel to the third side 140. The fourth side may be positioned, during use, adjacent to a first corner formed by the first and second surface. The first, second, third, and fourth sides may form a perimeter of the first and second molding block. In some embodiments, the first side 120 and the second side 130 may be substantially perpendicular to one another. The fourth side may in essence be considered as formed by removing a corner (e.g., at approximately 45 degrees) of the molding block which essentially has a triangular shape. However, the fourth side seemingly resulting from the removal of the corner performs an important function. With the corner removed, the first and the second side are able to more easily make contact with adjacent surfaces (e.g., the first surface and the third surface) which are not square. If a triangular molding block were used it might function to contact adjacent surfaces but would only make good contact with both surfaces if the two surfaces were at right angles to one another and the room is square. Of course in the real world of modern building few if any rooms are actually square, as they are supposed to be. With the current molding block described herein this limitation is overcome and with the fourth surface the molding block is able to make good contact with both adjacent surfaces. Making good contact with both adjacent surfaces will allow for the molding block to provide greater stability for the molding coupled to the molding block as well as properly position the molding relative to the surfaces.

In some embodiments, molding blockers may be provided in a variety of sizes. The size of a molding blocker may be dependent upon a width of a molding such that the length of the third side is substantially equivalent to the width of the molding or at least the width of a planar flat portion of the molding. Molding blockers may be sized to accommodate any type of molding width or any angle of attachment of the molding. Typically molding is attached at a standardized angle relative to a wall (e.g., first or second surface). In some embodiments, the angle is less than 45 degrees. FIG. 1 depicts a diagram of a perspective view of an embodiment of molding block 110, which depicts a molding block configured to support molding which sits at an angle of less than 45 degrees relative to the wall to which it is coupled. As such first side 120 is longer than second side 130 such that third side 140 is at an angle to appropriately hang most molding. In some embodiments, first side 120 may be about 1-8 inches, about 2-5 inches, or about 2.38 inches. In some embodiments, second side 130 may be about 1-8 inches, about 2-5 inches, or about 1.88 inches. In some embodiments, the third side may include indicia to indicate a midpoint of the third side (e.g., a line, or arrow). Indicia may be used to indicate which side should abut a particular surface (e.g., a ceiling) using, for example, an arrow and or words (e.g., "ceiling").

In some embodiments, an ornamental molding kit may include a first molding 190*a* and a second molding 190*b*. The first molding and the second molding may include a lower side 200, an upper side 210, a first end 220, and a second end 230. The upper side may be substantially opposite to the lower side. The second end may be substantially opposite the first end. The lower side adjacent the first end of the first molding may be coupled, during use, to a portion of the third side of the first molding block such that the second end of the first molding is positioned adjacent to the second surface. The lower side adjacent the first end of the second molding may be coupled, during use, to a portion of the third side of the second molding block such that the second end of the second molding is positioned adjacent to the first surface such that the second ends of the first and second moldings connect forming a first joint. In some embodiments, the first joint may form a substantially right angle between the first and second moldings are coupled at a substantially right angle. The second end being precut at an appropriate angle such that the molding forms a right angle. The first end, in some embodiments, may be straight and used to form one half of a but joint.

In some embodiments, a crown molding may only be coupled to a portion (e.g., 50%) of a third surface of a molding block such that the remaining portion of the third surface may be used to support a third molding which is coupled to the molding block forming a but joint with the first end of the first molding. The third side may include indicia to indicate a midpoint of the third side (e.g., a line, or arrow).

This disclosure describes systems and methods for facilitating the installation of ornamental molding (e.g., crown molding). In some embodiments, a method of installing molding may include coupling a first molding block in a first corner formed by a first surface and a third surface and at a first distance from a second corner formed by the first surface and a second surface. The method may include coupling a lower side adjacent a first end of a first molding to a portion of a third surface of the first molding block such that a second end of the first molding is adjacent the second corner. In some embodiments, the first molding includes a first length and the first molding block includes a first width is less than about 25% of the first length of the first molding. The method may include coupling a second molding block in a third corner formed by a second surface and a third surface and at a second distance from the second corner. The method may include coupling a lower side adjacent a first end of a second molding to a portion of a third surface of the second molding block such that a second end of the first crown molding is adjacent the second corner such that the second ends of the first and second moldings connect forming a first joint such that the first and second moldings are coupled at a substantially right angle (e.g., about 80 to 100 degrees).

Current molding kits include preassembled corner pieces already formed in the shape of an inside or outside ninety degree corner. Disadvantages arise from such systems which are overcome by systems and methods described herein. A disadvantage may arise when such preassembled corner pieces are coupled to surfaces in which the angles are not perfectly square and exactly ninety degrees, without flex build into preassembled corner pieces they typically split at the seem when coupled to irregular surfaces. This problem is quite common considering that in actuality few structures built in the modern era are anywhere close to square. The current systems and methods solve that problem by providing the tools to facilitate even an unskilled worker or homeowner to assemble a molding corner piece on site even against uneven walls and/or walls which are not square. With the second ends of the first and second molding unattached initially an installer may adjust the ends relative to one another to compensate for walls out of square.

In some embodiments, the first molding comprises a first length and the first molding block comprises a first width which is less than about 50%, about 35%, about 25%, or about 15% of the first length of the first molding. In some embodiments, molding included in a kit may include a length of about 6-24 inches, about 8-18 inches, or about 8-10 inches. In some embodiments, molding blockers included in a kit may include a width of about 1-3 inches, about 1-2 inches, or about 1.5 inches. There are many advantages to having a molding block be substantially smaller relative to a molding. An advantage may include allowing more adjustment of the molding relative to the molding block to facilitate alignment of the first and second moldings to form a corner piece when the walls of a structure are not aligned at perfectly right angles. Current systems which include molding blocks with relatively long lengths/widths relative to molding pieces may not allow for such fine adjustments. An advantage of may include allowing more adjustment of the molding relative to a ceiling of a structure especially when the ceiling has an uneven surface. Relatively short molding blocks may allow for flexible molding to be bent between the molding blocks to better align with the uneven surface.

As such circumstances warrant the molding blocks may be positioned at various intervals along a surface to provide support for an extended run of molding. In some embodiments, molding blocks may be positioned along a surface about every 3-4 feet, about every 2-5 feet, or about every 1-6 feet.

In some embodiments, the lower side of the first and/or second molding may be substantially planar. A substantially flat, planar surface may facilitate coupling of the molding to the molding block. The entire lower side is not required to be planar to facilitate coupling, merely a portion.

In some embodiments, a kit may include at least one spacer. At least one of the spacers may function to be inserted into any opening during installation of the kit to provide stability. Any gaps which result in openings and/or instability of the molding during and/or after installation may be filled using spacers. Spacers may include small thin portions of material which may be formed from a variety of materials (e.g., wood, plastic, cardboard, paper, etc.).

The moldings may include any type of ornamental moldings. The moldings may include crown molding. In some embodiments, the upper side of the first and/or second molding may include ornamental elements. Ornamental elements may include different shapes and/or patterns commonly used in residential and commercial construction. Ornamental elements are only limited by ones imagination considering modern production techniques.

Molding and molding blocks may be formed from any number of common construction materials. In some embodiments, the first molding may be formed from wood, plastic, fiberglass, clay, or plaster. In some embodiments, the first molding block may be formed from wood, plastic, fiberglass, clay, or plaster.

The system and method described herein may be used to install ornamental molding around "inside" and "outside" corners in either residential or commercial buildings or any structure with multiple surfaces intersecting at substantially right angles (e.g., 80-100 degrees) to one another. In some embodiments, the first surface may include a first wall of a building. The second surface may include a second wall of a building. The third surface may include a ceiling of a building.

In some embodiments, a molding block may include an opening 240 in the third side. The opening may extend toward the fourth side of the molding block. A fastening device may be positionable in the opening and configured to couple the first or second molding block to a structural element. The opening may extend through the entirety of the molding block or only partially through the molding block facilitating insertion of the fastening device. The opening may ensure that the fastening device is inserted at an appropriate angle relative to the molding block. In some embodiments, fastening devices may include screws or nails.

In instances where the molding is installed in, for example, a residential building if a fastener is inserted through the molding block at an incorrect angle, the fastener may not penetrate an appropriate material (e.g., sheet rock) ensuring a secure coupling of the molding block to a surface. The opening may be angled relative to the molding block to facilitate the fastener penetrating a structurally sound element (e.g., wooden top plate of a framed wall) ensuring secure fastening of the molding block.

In some embodiments, an ornamental molding hanging device 300 may include a fastening device 310 and an elongated flexible member 320. Fastening device 310 may include an opening 330 coupled to the fastening device. The fastening device may function to couple to a surface. An elongated flexible member may be positionable, during use, in the opening. The elongated flexible member may be couplable to itself. The flexible member may couple, during use, an ornamental molding to the fastening device. The elongated flexible member may include a hook and loop fastener. The fastening device may include a nail. The fastening device comprises a screw.

In some embodiments, a method of installing ornamental molding may include coupling a fastening device to a surface. The method may include positioning a portion of an elongated flexible member through an opening coupled to the fastening device. The method may include securing an ornamental molding to the fastening device using the elongated flexible member. The method may include coupling the ornamental molding to the surface. The method may include releasing the ornamental molding from the elongated flexible member. In some embodiments, the method may include removing the elongated flexible member from the opening coupled to the fastening device. In some embodiments, the method may include leaving the fastener coupled to surface beneath the installed molding. In some embodiments, a second fastener may be used in combination with original flexible member or second flexible member to install a second molding.

In this patent, certain U.S. patents, U.S. patent applications, and other materials (e.g., articles) have been incorporated by reference, namely, U.S. Provisional Patent Application Nos. 61/534,175; 61/534,186; and 61/589,996, incorporated by reference above. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An ornamental molding kit, comprising:

a first molding block and a second molding block, each comprising:

a first side, wherein the first side of the first molding block is coupled, during use, to a first surface, and wherein the first side of the second molding block is coupled, during use, to a second surface substantially perpendicular to the first surface;

a second side substantially perpendicular to the first side, wherein the second side of the first molding block and the second molding block is coupled, during use, to a third surface perpendicular to the first surface and the second surface;

a third side coupling and substantially opposite the first side and the second side; and a fourth side coupling the first side and the second side, wherein the fourth side is opposite and substantially parallel to the third side, wherein the fourth side of the first molding block is positioned, during use, adjacent to a first corner formed by the first and third surface, wherein the fourth side of the second molding block is positioned, during use, adjacent to a second corner formed by the second and third surface, and wherein the first, second, third, and fourth side form a perimeter of the first and second molding block, wherein the third side of the first molding block, the third side of the second molding block, or combinations thereof, comprise an opening therein;

a first molding and a second molding, each comprising:

a lower side;

an upper side substantially opposite to the lower side;

a first end; and a second end substantially opposite the first end, wherein the lower side adjacent the first end of the first molding is coupled, during use, to a portion of the third side of the first molding block such that the second end of the first molding is positioned adjacent to the second surface, wherein the lower side adjacent the first end of the second molding is coupled, during use, to a portion of the third side of the second molding block such that the second end of the second molding is positioned adjacent to the first surface such that the second ends of the first and second moldings connect forming a first joint such that the first and second moldings are coupled at a substantially right angle.

2. The kit of claim 1, wherein the first molding comprises a first length and the first molding block comprises a length which is less than or equal to about 25% of the first length of the first molding.

3. The kit of claim 1, wherein the lower side of the first molding, the lower side of the second molding, or combinations thereof is substantially planar.

4. The kit of claim 1, wherein the opening extends from the third side toward the fourth side.

5. The kit of claim 4, wherein a fastening device is positionable in the opening and configured to couple the first or second molding block to a structural element.

6. The kit of claim 1, further comprising:

an ornamental molding hanging device, comprising an opening coupled thereto, wherein the ornamental molding hanging device is configured to couple to the first or second surface; and an elongated flexible member positionable, during use, in the opening, wherein the elongated flexible member comprises a first portion and a second portion, and wherein the first portion is couplable to the second portion, and wherein the flexible member couples, during use, the first or second molding to the ornamental molding hanging device.

7. The kit of claim 6, wherein the elongated flexible member comprises a hook and loop fastener.

8. The kit of claim 1, wherein the third side of the first molding block, the second molding block, or combinations thereof comprises a first substantially planar surface, wherein the lower side of the first molding, the second molding, or combinations thereof comprises a second substantially planar surface, and wherein the first substantially planar surface of the third side is adapted to abut the second substantially planar surface of the lower side.

9. The kit of claim 1, wherein the second end of the first molding comprises a first pre-cut surface, wherein the second end of the second molding comprises a second pre-cut surface, and wherein the first pre-cut surface and the second pre-cut surface are adapted to abut to form the first joint such that the first and second moldings are coupled at a substantially right angle.

10. The kit of claim 9, wherein the first side of the first molding block, the second molding block, or combinations thereof comprises a first length and the second side of the first molding block, the second molding block, or combinations thereof comprises a second length, and wherein the first length and the second length are preselected to correspond to an angle of the first and second pre-cut surfaces such that coupling of the first and second moldings to the third side aligns the first molding with the second molding to form the first joint.

11. The kit of claim 1, wherein the opening extends from the third side toward a theoretical intersection between the first side and the second side such that a fastener positioned in the opening contacts the first corner between the first surface and the third surface, the second corner between the second surface and the third surface, or combinations thereof.

12. A method, comprising:

coupling a first molding block in a first corner formed by a first surface and a third surface and at a first distance from a second corner formed by the first surface and a second surface;

coupling a lower side adjacent a first end of a first molding to a portion of a third side of the first molding block such that a second end of the first molding is adjacent the second corner, wherein the first molding comprises a first length, and wherein the first molding block comprises a length that is less than or equal to about 25% of the first length of the first molding;

coupling a second molding block in a third corner formed by a second surface and a third surface and at a second distance from the second corner; and coupling a lower side adjacent a first end of a second molding to a portion of a third side of the second molding block such that a second end of the first crown molding is adjacent the second corner such that the second ends of the first and second moldings connect forming a first joint such that the first and second moldings are coupled at a substantially right angle, wherein the step of coupling the first molding block to the first corner comprises contacting the first surface with a first side of the first molding block and contacting the second surface with a second side of the first molding block, thereby positioning the third side of the first molding block in an orientation adapted to couple with the first molding and positioning a fourth side of the first molding block opposite the third side adjacent to the first corner.

13. The method of claim 12, wherein the step of coupling the first molding block to the first corner further comprises engaging a fastener with the first corner, through an opening extending from the third side to the fourth side, wherein the opening extends toward a theoretical intersection between the first side and the second side.

14. The method of claim 12, wherein the lower side of the first molding comprises a first substantially planar surface, wherein the third side of the first molding block comprises a second substantially planar surface, and wherein the step of coupling the lower side of the first molding to the third side of the first molding block comprises contacting the first substantially planar surface with the second substantially planar surface.

15. The method of claim 12, wherein the second end of the first molding comprises a first pre-cut surface, wherein the second end of the second molding comprises a second pre-cut surface, and wherein the step of coupling the lower side of the second molding to the third surface of the second molding block comprises abutting the first pre-cut surface with the second pre-cut surface to form the first joint.

16. A molding block, comprising:

a first side, wherein the first side is coupled, during use, to a first surface;

a second side substantially perpendicular to the first side, wherein the second side is coupled, during use, to a third surface perpendicular to the first surface and a second surface;

a third side coupling and substantially opposite the first side and the second side;

a fourth side coupling the first side and the second side, wherein the fourth side is opposite and substantially parallel to the third side, wherein the fourth side is positioned, during use, adjacent to a first corner formed by the first and second surface, and wherein the first, second, third, and fourth side form a perimeter of the first and second molding block; and an opening extending from the third side to the fourth side, wherein the opening extends toward a theoretical intersection between the first side and the second side.

17. The molding block of claim 16, wherein the third side comprises a substantially planar surface adapted to abut a corresponding planar surface of a molding.

* * * * *